United States Patent [19]

Christoffersson et al.

[11] Patent Number: 4,993,293

[45] Date of Patent: Feb. 19, 1991

[54] APPARATUS FOR THE REMOVAL OF MATERIAL PUNCHED OUT FROM MATERIAL IN SHEET FORM

[75] Inventors: Bjoern Christoffersson, Helsingborg, Sweden; Joergen Gerhardt, Roenne Alle 40, DK-2791, Denmark

[73] Assignee: Joergen Gerhardt, Kastrup, Denmark

[21] Appl. No.: 503,934

[22] Filed: Apr. 4, 1990

[30] Foreign Application Priority Data

Jun. 6, 1989 [DE] Fed. Rep. of Germany ..... 3918470

[51] Int. Cl.[5] ..... B26D 7/1

[52] U.S. Cl. ..... 83/098; 83/24; 83/346; 83/167

[58] Field of Search ..... 83/24, 98, 343, 346, 83/167, 168

[56] References Cited

U.S. PATENT DOCUMENTS

| | | | |
|---|---|---|---|
| 3,651,724 | 3/1972 | Huffman | 83/98 |
| 3,680,419 | 8/1972 | Stoop | 83/98 |
| 4,165,028 | 8/1979 | Doherty | 226/4 |
| 4,534,248 | 8/1985 | Andersson | 83/24 |
| 4,648,409 | 3/1987 | Mattei | 83/98 |
| 4,671,152 | 6/1987 | Blümle | 83/24 |

FOREIGN PATENT DOCUMENTS

| | | |
|---|---|---|
| 3115688 | 10/1982 | Fed. Rep. of Germany . |
| 156234 | 8/1982 | German Democratic Rep. . |

*Primary Examiner*—Douglas D. Watts
*Assistant Examiner*—Scott A. Smith
*Attorney, Agent, or Firm*—Foley & Lardner, Schwartz, Jeffery, Schwaab, Mack, Blumenthal & Evans

[57] ABSTRACT

The invention relates to an apparatus for the removal of areas of material punched out from a material in sheet form by projecting, closed punching edges on the circumferential surface of at least one rotating punching cylinder by means of compressed air, which is fed into the punching cylinder and led out from the punching cylinder through outlet openings lying within the closed punching edges, wherein the compressed air from an opening in a side face of a member at least partially embracing the punching cylinder in a guided manner is fed to inlet openings assigned to the outlet openings, which inlet openings are located in a side face of the punching cylinder closely adjacent to the side face of the member.

13 Claims, 7 Drawing Sheets

APPARATUS FOR THE REMOVAL OF MATERIAL PUNCHED OUT FROM MATERIAL IN SHEET FORM

BACKGROUND OF THE INVENTION

The invention relates to an apparatus for the removal of areas of material punched out from a material in sheet form by projecting, closed punching edges on the circumferential surface of at least one rotating punching cylinder by means of compressed air, which is fed into the punching cylinder and is led out from the punching cylinder through outlet openings lying within the closed punching edges.

In an apparatus of this type known from the brochure "Preston" PE 752-7/85 compressed air is introduced into an axial channel of the punching cylinder through an axially displaceable pipe, in the wall of which there are holes. The pipe is to be sealed off from the channel on both sides of these holes. This apparatus is not only structurally complicated, it also does not allow strong surges of compressed air to be fed to the outlet openings within the closed punching edges.

SUMMARY OF THE INVENTION

It is an object of the invention to provide an apparatus of this type which is of a simple design and allows strong compressed air surges to be fed to the outlet openings within the punching edges.

It is a further object of the invention to provide a device to lessen the momentum which the punched-out materials receive from the compressed air and to receive and pass on the punched-out material.

In accomplishing the foregoing objects, there has been provided according to one aspect of the present invention an apparatus for the removal of material punched out from a material in sheet form, which has at least one rotating punching cylinder including a circumferential surface with projecting, closed punching edges, outlet openings located within the closed punching edges connected to assigned inlet openings arranged in a side face of said punching cylinder, and an opening located in a side face of a member. This member embraces at least partially said punching cylinder in a guided manner, and its side face is closely adjacent to said face of said punching cylinder, wherein compressed air is fed from this opening in the member through said inlet openings of the punching cylinder to the outlet openings of the punching cylinder to remove the punched out material.

A path between the opening in the side face of the fork and the outlet openings in the punching cylinder can be kept short. The fork acts in relation to the inlet openings in the punching cylinder as a valve slide. This has strong compressed air surges as a consequence.

A particularly simple embodiment has at least one outlet opening lying in each closed punching edge, to which outlet opening a separate inlet opening is assigned. However, in principle, a plurality of outlet openings may also lie within each closed punching edge or some of the closed punching edges, which outlet openings are in each case assigned to a separate inlet opening.

An embodiment wherein the outlet openings and the inlet openings are ports of bores intersecting at right angles is technically particularly simple in terms of production. In order to adapt the position of the punching cylinder to the respective conditions prevailing, it is preferred to provide an apparatus wherein the punching cylinder is seated axially displaceably and fixedly secured against twisting on a drive shaft.

An embodiment wherein the member can be displaced axially and radially and fixed with respect to the punching cylinder provides simple handling, in particular in the case of adjustable punching cylinders.

A particularly suitable material for the punching cylinder is steel and for the member an abrasion-resistant, self-lubricating, temperature-resistant plastic, in particular a thermoplastic, a fluoroplastic or a polyamide.

The member from which the compressed air enters the punching cylinder may be in the form of a fork, which facilitates assembly, or in the form of a ring, which reduces compressed air losses.

In order to be able to predetermine the period of time during which compressed air leaves the outlet openings of the punching cylinder, an embodiment wherein the opening in the side face of the member is elongate in the circumferential direction of the punching cylinder is preferably provided.

In order to lessen the momentum which the punched-out areas of material receive from the compressed air and to receive and pass on the punched-out areas of material, an apparatus is preferably provided, wherein a box with an entry slit, directed at the pressurized outlet openings of the punching cylinder, is provided for receiving and passing on the punched-out material, the inside surfaces of the box are designed to multiply reflect the punched-out material and wherein an extraction stub for the punched-out material opens out above a bottom region of the box.

In order to achieve the effect that punched-out areas of material do not fly past the entry slit of the box, an embodiment is preferably provided wherein the material in sheet form is passed through a gap between the punching cylinder and a counterbearing cylinder, rotatably mounted under the punching cylinder, and wherein the entry slit of the box is bounded at the bottom by a wall of the box directed upwards at an angle approximately tangentially to the counterbearing cylinder, on which wall a wiper, scraping off the cylindrical surface of the counterbearing cylinder, is attached.

Particularly high losses of momentum of the punched-out material are obtained by an embodiment, wherein the entry slit of the box is bounded at the top by a wall of the box, pointing away from the punching cylinder, which makes the space inside the box for the punched-out material like a labyrinth.

The punching cylinders may be axially short or long. If they are short, their form is closer to that of a disk than a cylinder in the way these terms are usually used.

The apparatus is suitable for the removal of any material in sheet form from punched-out material, such as for the removal of punching rests from edges of webs perforated by punching, but also for the removal of labels punched out from material in sheet form. The punching cylinders may have the form of electronic data-processing punching rings, be designed as solid bodies, be made up from segments or else consist of a carrier cylinder with punching sleeve fitted on.

The invention is explained below by exemplary embodiments with reference to the enclosed drawings.

DETAILED DESCRIPTION OF THE PREFERRED EMBODIMENT

Figure 1:
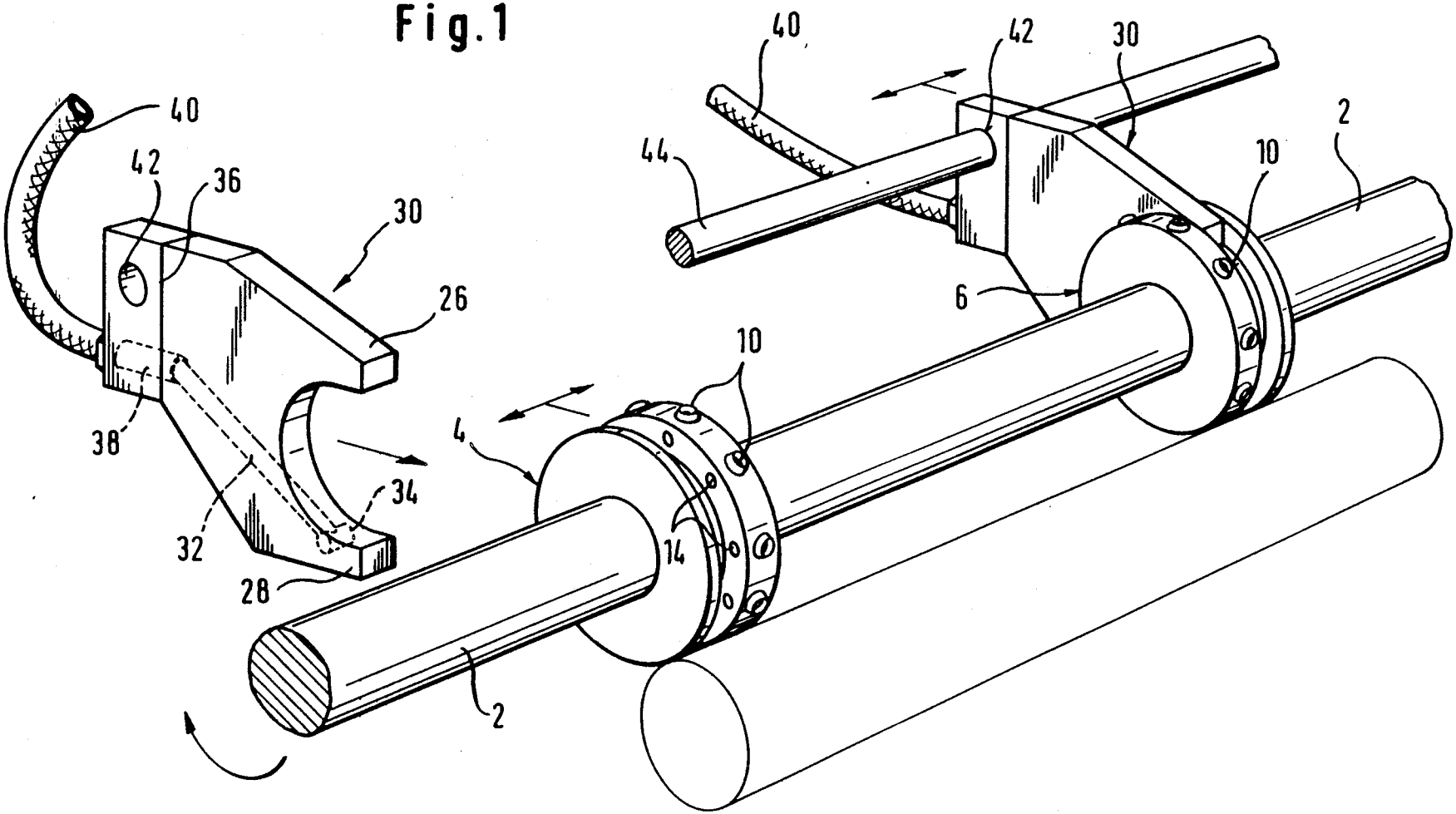
FIG. 1 perspectively shows two disk-shaped punching cylinders with forks interacting with them.
Figure 2:
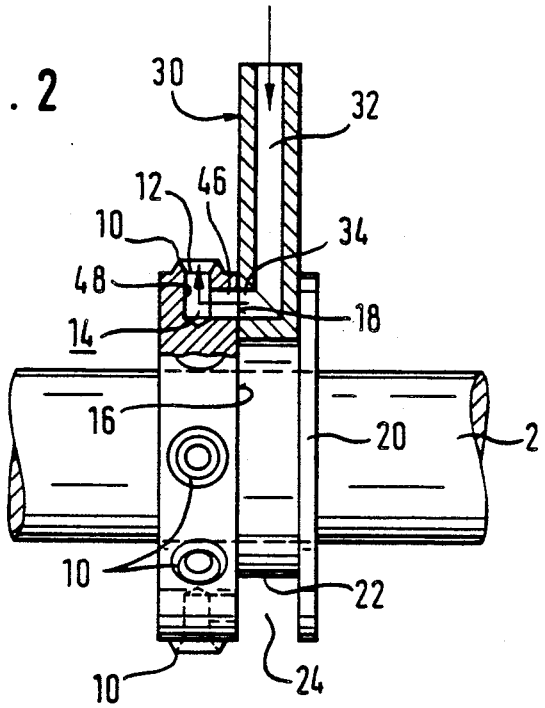
FIG. 2 shows, partially in section, a view of a punching cylinder according to FIG. 1, from its narrow side, with assigned fork.
Figure 3:
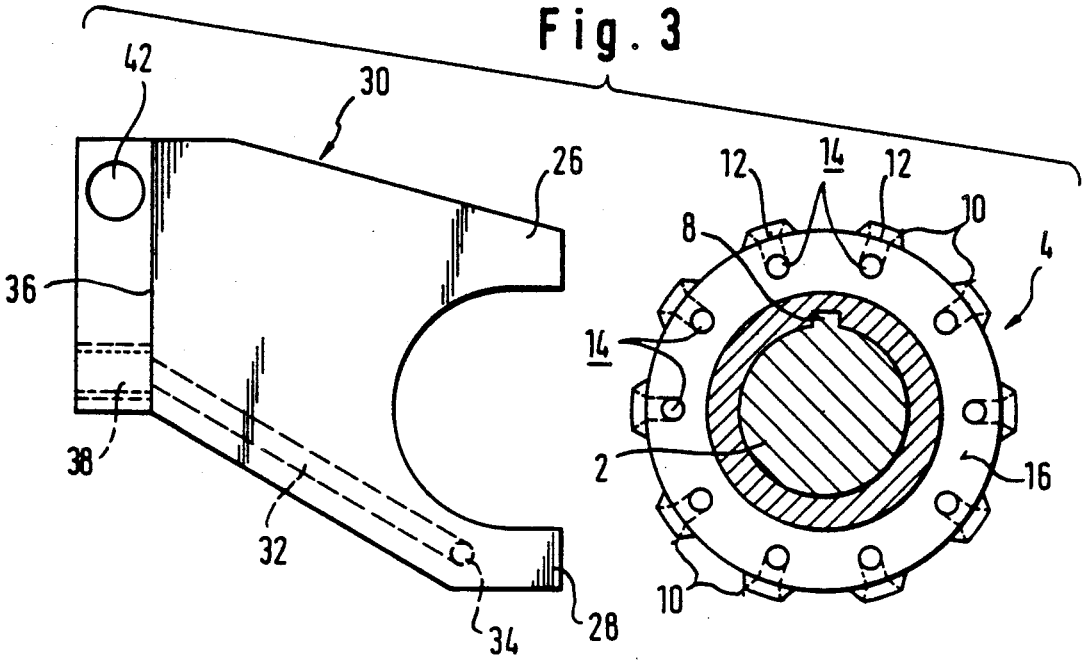
FIG. 3 shows a side view of a punching cylinder according to FIG. 1, with assigned fork, partially in section.

FIGS. 1 to 3 show a fixed-mounted shaft 2, which is to be driven and on which two disk-shaped punching cylinders 4, 6 are seated axially displaceably and fixedly in a manner secure against twisting. The connection secure against twisting is accomplished by a key on the shaft engaging in a groove 8 in each of the punching cylinders 4, 6.

On the circumferential surface of the punching cylinders 4, 6 there are circular, closed punching edges 10 in each of which there opens out an outlet opening 12 of a channel 14, which has an inlet opening 18, opening out in a side face 16 of the punching cylinder 4, 6. Opposite the side face 16 is a flange 20 on a cylindrical extension 22 of the punching cylinder 4, 6, which has a smaller outside diameter than the punching cylinder 4, 6. The resulting annular space 24 is adapted to arms 26, 28 of a fork 30, in which there is a compressed air feed channel 32. This compressed air feed channel 32 ends in a lateral opening 34 of the arm 28 of the fork 30 and has at the shank end 3 of the fork 30 a connecting stub 38, to which a compressed air feed tube 40 is to be connected. The fork 30 is provided with a guide hole 42, which runs parallel to the shaft 2 and through which a shaft 44 passes. The shaft 44 is mounted radially displaceably relative to the shaft 2. The fork 30 can consequently be displaced axially and radially with respect to the punching cylinder 4 or 6 respectively assigned to it. During operation the fork 30 is stationary and the punching cylinder 4 or 6 rotates. The compressed air leaving the opening 34 of the fork 30 thus passes successively into the inlet openings 18 of the short channels 14 and, if at the transition from one channel 14 to a following channel 14 the compressed air cannot be introduced into one of the inlet openings 18, the compressed air is accumulated. Thus, very high compressed air surges are generated.

FIG. 2 shows that the inlet openings 18 and the outlet openings 12 are ports of bores 46 and 48, intersecting at right angles and forming the channel.

Figure 4A:
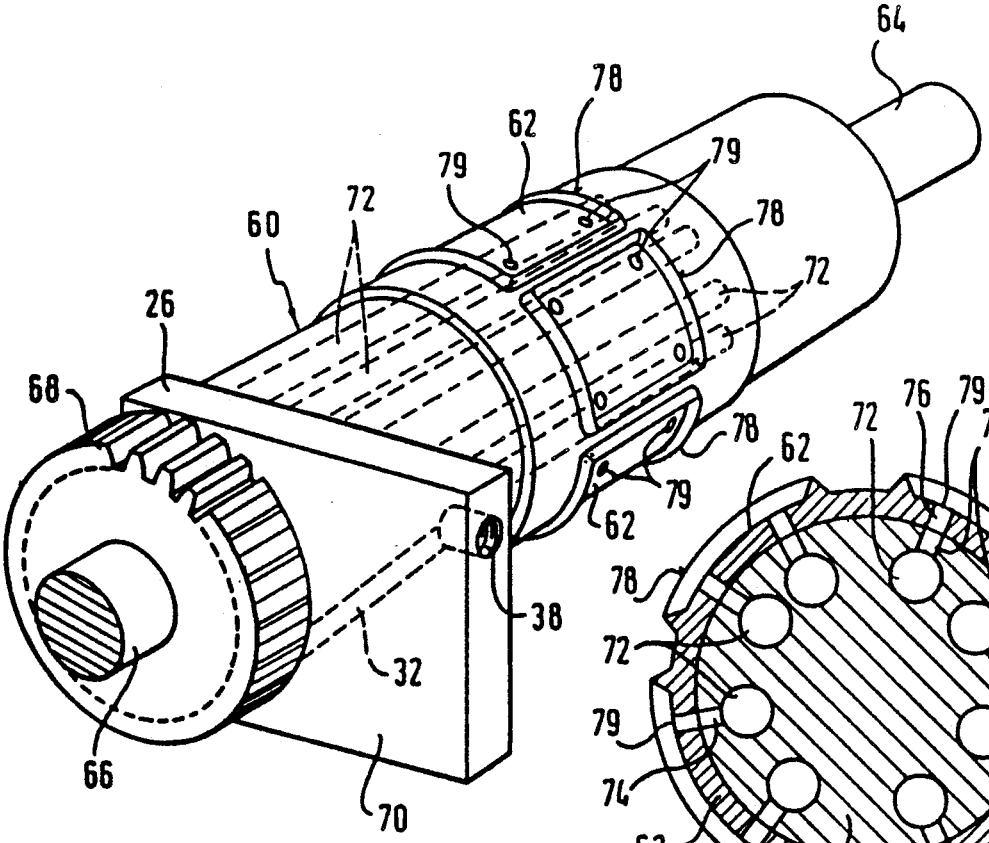
FIGS. 4*a* and 4*b* a punching cylinder with fitted-on punching segments and assigned fork.
Figure 4B:
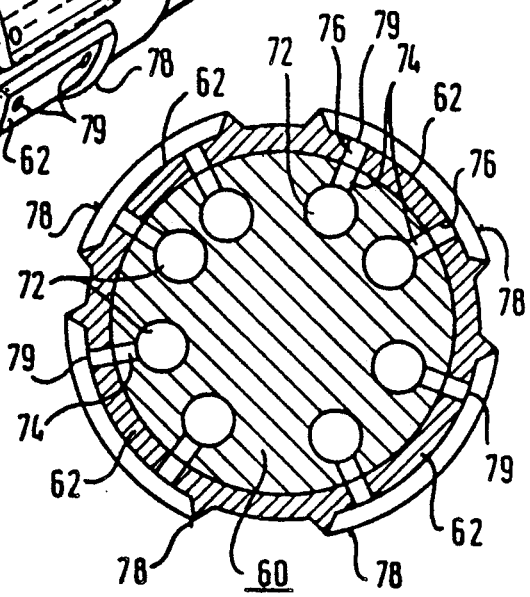

In the embodiment according to FIGS. 4*a* and 4*b*, an elongate carrier cylinder 60 of punching segments 62 is provided, which has axial journals 64, 66 for mounting. At one end of the carrier cylinder 60 there is a drive gear 68, which runs at an axial distance from an end face of the carrier cylinder 60 and thus leaves space for a fork 70, which is of a basically similar design to the fork 30 according to FIGS. 1 to 3. Therefore, the same reference numerals have been used for the corresponding elements. Axial bores 72, which correspond to the bores 46, and radial bores 74, which correspond to the radial bores 48, run in the carrier cylinder. These radial bores 74 coincide with bores 76 in the punching segments 62. In this case, each closed punching edge 78 of the punching segments 62 encloses four outlet openings 79.

Figure 5:
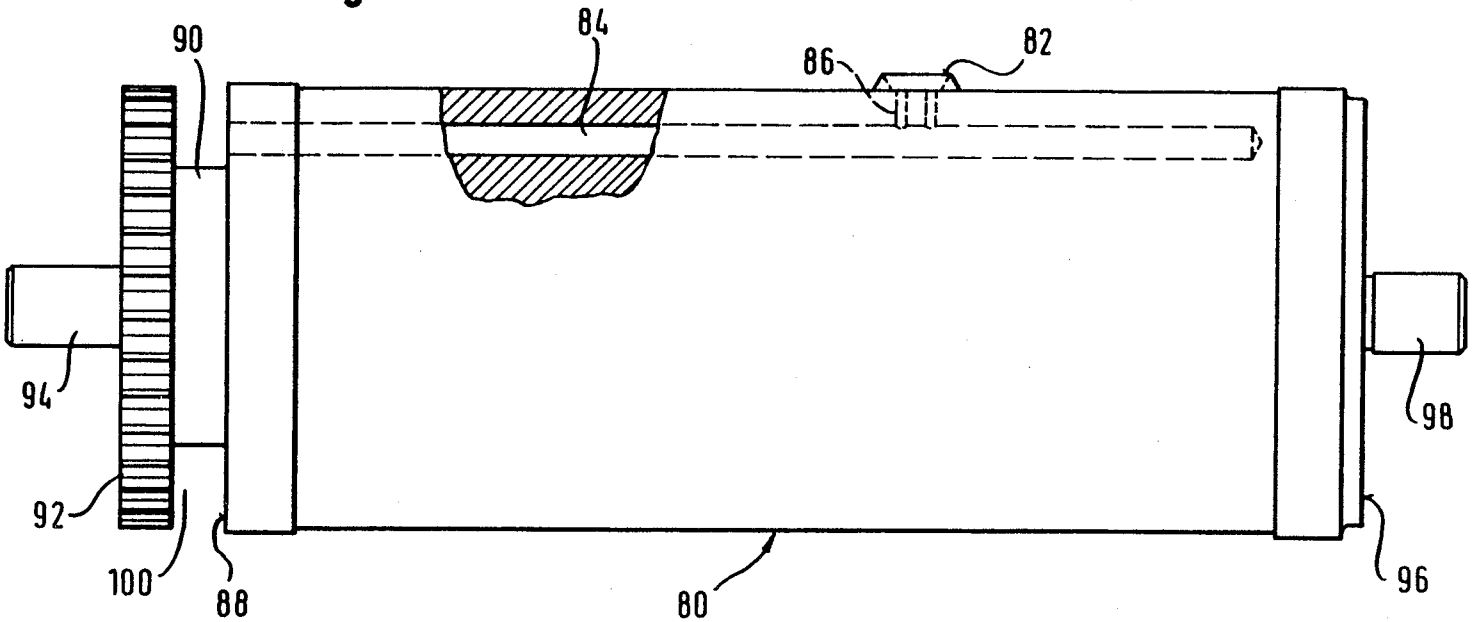
FIG. 5 shows a side view of a punching cylinder.

FIG. 5 shows a punching cylinder 80, on which only one of a plurality of closed punching edges 82 is indicated. Axial bores 84, which correspond to the axial bores 46, and radial bores 86, which correspond to the radial bores 48, extend through the punching cylinder 80. At a distance from the end face 88 of the punching cylinder 80 there is a gear 92 attached via a cylindrical extension 90 of reduced diameter, on the outside of which gear there is a bearing journal 94. On the other end face 96 of the punching cylinder 80 there is likewise a bearing journal 98 attached. The space 100 between the end face 88 and the gear 92 serves for receiving the fork (not shown).

Figure 6:
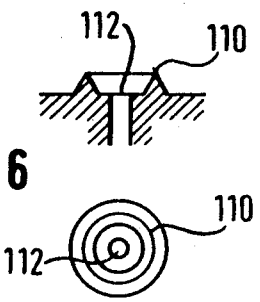
FIG. 6 shows a closed punching edge, in which a compressed air outlet opening is arranged.

FIG. 6 shows a circularly closed punching edge 110, in which an outlet opening 112 opens out centrally.

Figure 7:
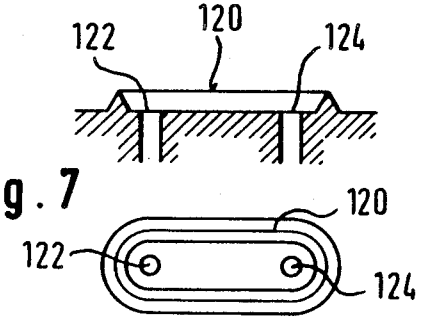
FIG. 7 shows a closed punching edge, in which two compressed air outlet openings are arranged.

FIG. 7 shows an elongate, closed punching edge 120, in each of the end regions an outlet opening 122, 124 for compressed air opens out.

Figure 8:
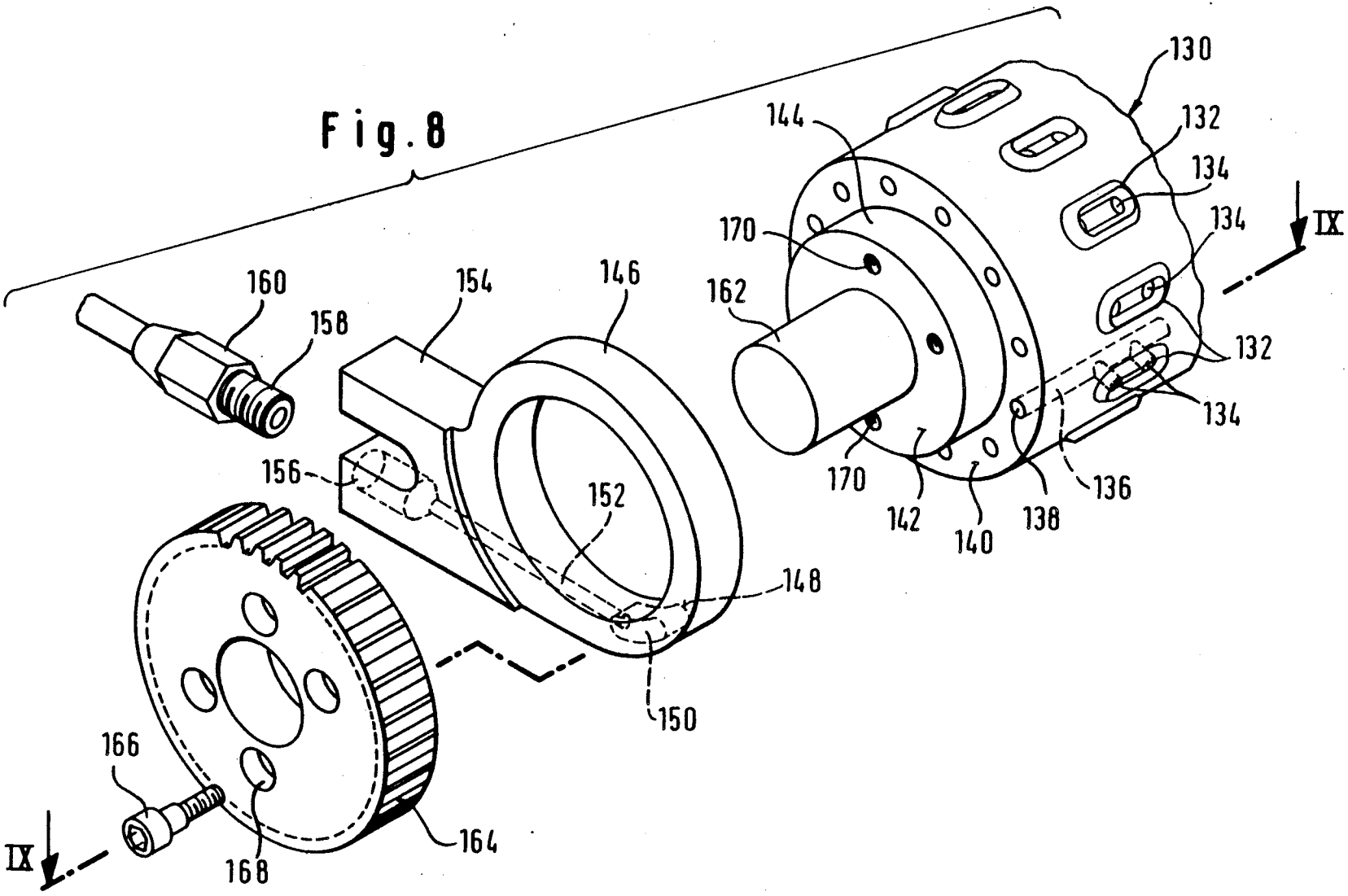
FIG. 8 shows in an exploded representation one end of a punching cylinder with a ring interacting with it and a drive gear.
Figure 9:
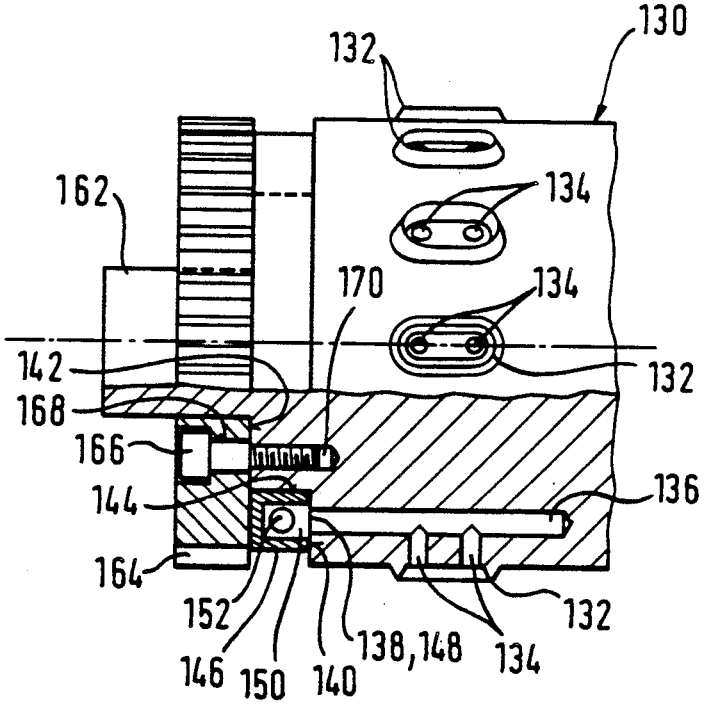
FIG. 9 shows a section along the line IX—IX in FIG. 8 after the parts represented in FIG. 8 were mounted together.

FIGS. 8 and 9 show a punching cylinder 130 with projecting, closed punching edges 132, within which outlet openings 134 for compressed air open out. The compressed air is fed to the outlet openings 134 via channels 136, which are formed within the punching cylinder 130 and have inlet openings 138 on a lateral annular face 140 of the punching cylinder 130. The annular face 140 encloses a cylinder extension 142 on the punching cylinder 130, the circumferential surface 144 of which extension is the bearing surface for an annular part 146. In the side face 148 facing the annular face 140 there opens out an opening 150, which is elongate in the circumferential direction of the punching cylinder 130 and from which compressed air is to be fed successively to the inlet openings 138 via a channel 152 located in the annular part 146. A fork part 154, serving for assembly, is integrally attached to the annular part 146. The channel 152 ends on the inlet side in an internally threaded section 156, which can receive an externally threaded extension 158 on a compressed air feed part 160. On the cylindrical extension 142 there is a second cylindrical extension 162 of reduced diameter, onto which a gear 164 can be fitted. The gear 164 is to be firmly screwed into threaded holes 170 in the end face of the cylindrical extension 142 by means of screws 166, which pass through holes 168 in the gear 164.

Figure 10:
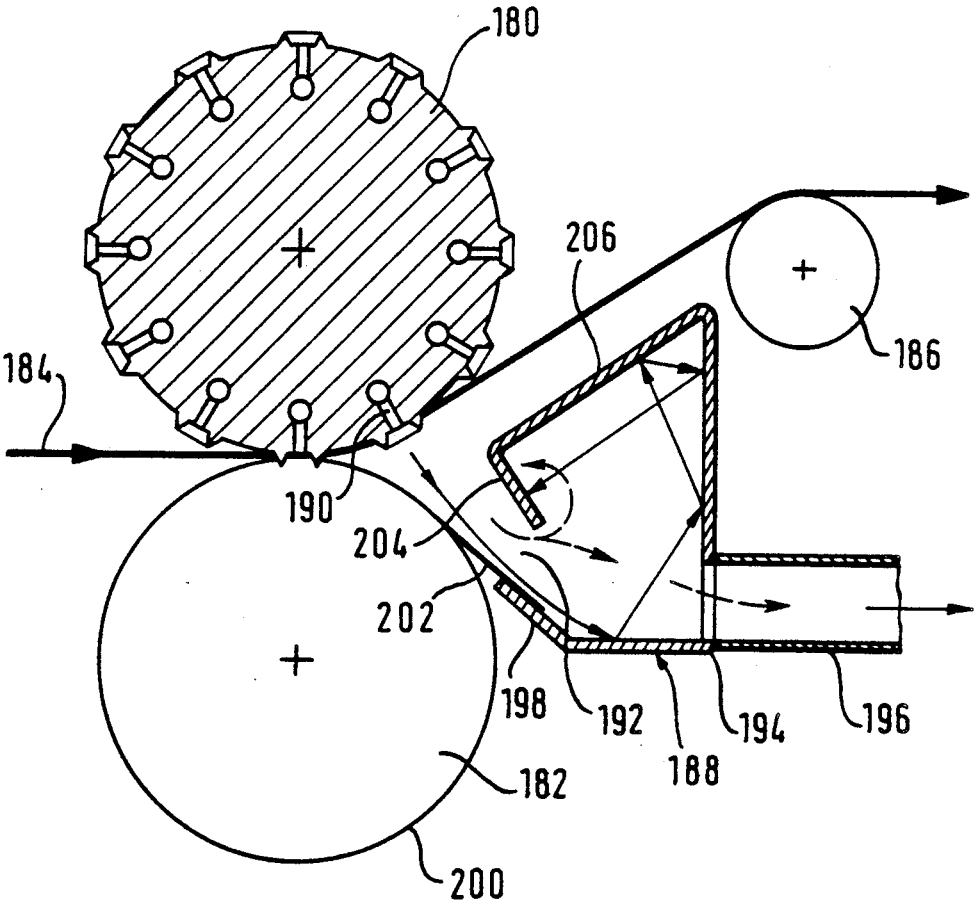
FIG. 10 shows a box for receiving the punched-out material in its interaction with a punching cylinder and a counterbearing cylinder.

FIG. 10 shows a punching cylinder 180, which interacts with a rotatably mounted counterbearing cylinder 182, arranged underneath it. Material in sheet form which is to be punched out is passed through a gap between the punching cylinder 180 and the counterbearing cylinder 182 and subsequently removed upwards at an angle over a rotatably mounted supporting roll 186. A box 188 with an entry slit 192, directed at the respectively pressurized outlet openings 190 of the punching cylinder 180, is provided for receiving and passing on the areas of material punched out from the material 184 in sheet form. The box 188 is designed on the inside as a type of labyrinth, on the inside surfaces of which box the punched-out areas of material are multiply reflected, as indicated by solid arrows. Compressed air draws through the box partly in a swirled form, as indicated by broken arrows. An extraction stub 196 for the punched-out areas of material opens out above a bottom region 194 of the box 188, which extraction stub is connected to an extraction device (not shown).

The entry slit 192 is bounded at the bottom by a wall 198, directed upwards at an angle approximately tangentially to the counterbearing cylinder 182, on which wall a wiper 202, scraping off the circumferential surface 200 of the counterbearing cylinder 182, is attached. At the top, the entry slit 192 of the box is bounded by a wall 204, pointing away from the punching cylinder 180, which wall forms in cross section with the wall 206 adjoining it of the box 188 approximately an L.

What is claimed is:

1. An apparatus for the removal of material punched out from a material in sheet form comprising:

at least one rotating punching cylinder including a circumferential surface with projecting, closed punching edges;

outlet openings located within the closed punching edges connected to assigned inlet openings arranged in a side face of said punching cylinder; a member at least partially embracing said punching cylinder in a guided manner; and a feed opening located in a side face of said member said side face being closely adjacent to said face of said punching cylinder, whereby compressed air can be fed from said feed opening through said inlet openings to said outlet openings to remove said punched out material.

2. An apparatus as claimed in claim 1, wherein at least one outlet opening lies within each closed punching edge, to which outlet opening a separate inlet opening is assigned.

3. An apparatus as claimed in claim 2, wherein the outlet openings and the inlet openings are ports of bores intersecting at right angles.

4. An apparatus as claimed in claim 1, wherein the punching cylinder is seated axially displaceably and fixedly secured against twisting on a drive shaft.

5. An apparatus as claimed in claim 4, wherein the member can be displaced axially and radially and fixed with respect to the punching cylinder.

6. An apparatus as claimed in claim 5, wherein the cylinder consists essentially of a steel and the member consists essentially of an abrasion-resistant, self-lubricating, temperature-resistant plastic.

7. An apparatus as claimed in claim 5, wherein the member is in the form of a fork.

8. An apparatus as claimed in claim 5, wherein the member is in the form of a ring.

9. An apparatus as claimed in claim 5, wherein the feed opening in the side face of the member is elongate in the circumferential direction of the punching cylinder.

10. An apparatus as claimed in claim 6, wherein the punching cylinder consists essentially of a thermoplastic, a fluoroplastic or a polyamide.

11. An apparatus as claimed in claim 1, further comprising a box wherein an entry slit, directed at the pressurized outlet openings of the punching cylinder is provided for receiving and passing on the punched-out material, the inside surfaces of said box being designed to multiply reflect the punched-out material, and an extraction stub for the punched-out material arranged above a bottom region of the box.

12. An apparatus as claimed in claim 11, further comprising a counterbearing cylinder rotatably mounted under the punching cylinder to form a gap, whereby the material in sheet form, is passed through the gap between the punching cylinder and a counterbearing cylinder, and wherein the entry slit of the box is bounded at the bottom by a wall of the box directed upwards at an angle approximately tangentially to the counterbearing cylinder, and further comprising on said wall a wiper for scraping off the cylindrical surface of the counterbearing cylinder.

13. An apparatus as claimed in claim 11, wherein the entry slit of the box is bounded at the top by a wall of the box, pointing away from the punching cylinder.

* * * * *